US005440608A

United States Patent [19]

Peralta et al.

[11] Patent Number: 5,440,608

[45] Date of Patent: Aug. 8, 1995

[54] METHOD AND SYSTEM FOR EXTENDING THE SERVICE LIFE OF AN X-RAY TUBE

[75] Inventors: Eduardo Peralta, Freeport, N.Y.; David V. Habif, Jr., 24 Grandview Ter., Tenafly, N.J. 07670

[73] Assignee: David V. Habif, Jr., Tenafly, N.J.

[21] Appl. No.: 90,703

[22] Filed: Jul. 13, 1993

[51] Int. Cl.[6] ..... H01J 35/10

[52] U.S. Cl. ..... 378/199; 378/200; 378/201; 378/210; 378/141

[58] Field of Search ..... 378/199, 200, 210, 201, 378/130, 141, 142, 4

[56] References Cited

U.S. PATENT DOCUMENTS

| | | | |
|---|---|---|---|
| 1,987,790 | 1/1935 | Mutscheller | 378/130 |
| 4,115,697 | 9/1978 | Hounsfield et al. | 250/445 T |
| 4,402,085 | 8/1983 | Distler et al. | 378/15 |
| 4,405,876 | 9/1983 | Iversen | 313/30 |
| 4,455,504 | 6/1984 | Iversen | 313/30 |
| 4,622,687 | 11/1986 | Whitaker et al. | 378/130 |
| 4,688,239 | 8/1987 | Schaffner et al. | 378/141 |
| 4,698,983 | 10/1987 | Hechavarria | 62/292 |
| 4,841,557 | 6/1989 | Haberrecker et al. | 378/141 |
| 4,866,743 | 9/1989 | Kroener | 378/4 |
| 4,918,714 | 4/1990 | Adamski et al. | 378/121 |
| 4,928,296 | 5/1990 | Kadambi | 378/141 |
| 4,938,315 | 7/1990 | Ohta et al. | 184/1.5 |
| 4,949,369 | 8/1990 | Bittl | 378/130 |
| 5,012,505 | 4/1991 | Zupancic et al. | 378/130 |
| 5,074,379 | 12/1991 | Batrice | 184/1.5 |
| 5,083,307 | 1/1992 | Meinel et al. | 378/200 |
| 5,099,955 | 3/1992 | Mangen et al. | 184/7.4 |
| 5,101,641 | 4/1992 | Van Steenburgh, Jr. | 62/292 |
| 5,168,720 | 12/1992 | Keltner | 62/292 |
| 5,222,118 | 6/1993 | Gerth | 378/200 |
| 5,242,032 | 9/1993 | Prestwood et al. | 184/1.5 |

OTHER PUBLICATIONS

"Replacement X-Ray Tube Price List & Cross Reference Guide"; Inmark Corp.; 1994; 4 pages.

Draft "Service Manual" from Siemans; Jun. 1983; 15 pages.

Section 5.4 of "Service Manual" from Siemans; 8 pages.

"Supplement to Adjustment Program AS-3" from version F onward from Siemans; May 1985; 40 pp.

"Tune Up Basics"; Jun. 4, 1984; 24 pp.

L. Campbell Tighe, "X-Ray Tubes/A Technology Review", *Second Source Imaging*, cover & pp. 49–54 (Nov. 1993).

*Primary Examiner*—David P. Porta
*Assistant Examiner*—Don Wong
*Attorney, Agent, or Firm*—Ratner & Prestia

[57] ABSTRACT

A method and system for extending the service life of an x-ray tube wherein the coolant fluid which is circulated through a closed circulation system to remove heat generated by the x-ray tube and provide electrical insulation between anode connections and ground (and/or cathode connections) is regularly changed based on predetermined criteria. In addition to the fluid change, an on-line fluoroscopy is also regularly performed based on a separate set of predetermined criteria.

14 Claims, 6 Drawing Sheets

METHOD AND SYSTEM FOR EXTENDING THE SERVICE LIFE OF AN X-RAY TUBE

FIELD OF THE INVENTION

The invention generally relates to x-ray tubes and, more particularly, it relates to extending the service life of an x-ray tube.

BACKGROUND OF THE INVENTION

One type of x-ray tube is a computerized tomography (CT) x-ray tube which is used in CT scanners.

FIG. 1 shows one type of CT scanner which is described in U.S. Pat. No. 5,086,449. The CT scanner includes a stationary patient receiving region 10. A gantry 12 is mounted for rotation around the patient receiving region 10. An x-ray tube assembly 14 which produces a radiation beam through an x-ray port across the patient receiving region 10 is mounted to gantry 12 for purposes of rotation. Coolant fluid is circulated between x-ray tube assembly 14 and a cooling system 17 (including heat exchanger and pump) which is also mounted on the gantry 12. The coolant fluid flows through x-ray tube assembly 14 to remove heat created during x-ray generation. Finally, an arc or ring of radiation detectors 28 surround the patient receiving region.

During operation, typically, x-ray tube assembly 14 generates a planar beam of radiation which is then rotated around the body. Various detectors 28, located around the patient, detect the intensity of the beam. Detectors 28 are connected to a computer which, based on intensity readings, generates an image of a slice of the body. The patient is then moved longitudinally through the gantry with the x-ray tube assembly 14 generating slices so that the computer can generate a three-dimensional image of the body.

In the course of generating slices, much heat is generated by x-ray tube assembly 14 and this heat must be removed if the service life of the x-ray tube is not to be unduly reduced. As described above, it is known to cool x-ray tubes by circulating a fluid, typically oil, within the tube and externally through a cooling system to remove as much heat as possible. In addition to being used as vehicle for cooling, the fluid is also used for its dielectric properties in order to insulate the anode connection from ground (and/or the cathode connection).

Even employing this type of fluid for purposes of cooling and electrical insulation, x-ray tubes have a finite service life. There are several causes of x-ray tube failure, most of which are related to thermal characteristics of the x-ray tube. Hence, heat removal is an important concern in attempting to extend the service life of an x-ray tube.

A first type of tube failure is related to excessive anode temperature during a single exposure which may result in localized surface melting and pitting of the anode.

A second type of tube failure results from maintaining the anode at elevated temperatures for prolonged periods. If the thermal stress on an x-ray tube anode is maintained for prolonged periods, such as during fluoroscopy, the thermal capacity of the total anode system and of the x-ray tube housing is the limitation to operation.

During flouroscopy, the rate of heat dissipation from the rotating target attains equilibrium with the rate of heat input. Although this rate is rarely sufficient to cause surface defects in the target, the tube can fail because of the continuous heat delivered to the coolant fluid, the rotor assembly, and/or the x-ray tube housing.

Coolant fluid, due to continuous heat and repeated arcing, will eventually break down. When the oil breaks down its dielectric properties as well as its ability to carry away heat (i.e. viscosity) are adversely affected. This results in less electrical insulation between the anode connection and ground connections (and/or the cathode connection) which leads to more arcing and, eventually, tube failure. Hence, proper electrical insulation (i.e., maintaining the proper dielectric property of the coolant fluid) is also an important concern in attempting to extend the service life of an x-ray tube.

A third type of failure involves the filament. Because of the high temperature of the filament, tungsten atoms are slowly vaporized and plate the inside of the glass envelope, even with normal use. This tungsten, along with that vaporized from the anode, disturbs the electrical balance of the x-ray tube, causing abrupt, intermittent changes in tube current, which often leads to arcing and tube failure.

Due to the above-described potential problems in current x-ray tube designs, manufacturers of CT x-ray tubes, which generally cost approximately $25–40,000, typically include a warranty for 40,000 slices, where a slice is a single picture taken by the CT scanner.

In a typical radiology center, one CT scanner running full time uses any where from 1–4 x-ray tubes a year which becomes very expensive. Obviously, it would be very advantageous, in terms of time and money, for a radiology center or the like to be able to extend the service life of an x-ray tube.

SUMMARY OF THE INVENTION

The present invention involves a method and system for extending the service life of an x-ray tube. In a radiographic apparatus having an x-ray tube coupled to a cooling system, wherein the cooling system circulates an existing fluid through a closed circulation system including the x-ray tube to remove heat and provide electrical insulation, it is determined, based on predetermined criteria, whether the existing oil should be replaced. If so, an acess to the closed circulation system is opened to the existing fluid. Then, the existing fluid is replaced with new fluid by way of the access. And, finally, the access to the closed circulation system is closed.

BRIEF DESCRIPTION OF THE FIGURES

The invention is best understood from the following detailed description when read in connection with the accompanying drawings, in which.

DESCRIPTION OF THE INVENTION

A. Overview

Figure 1:
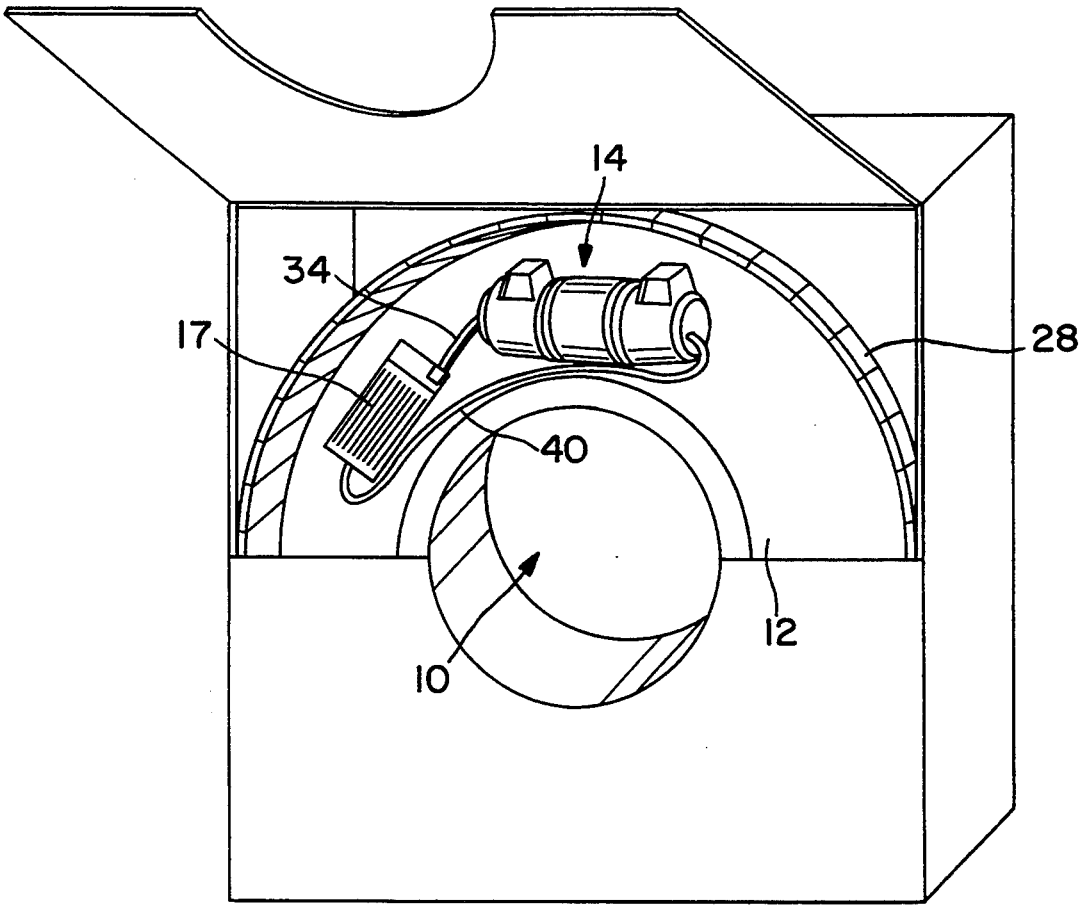
FIG. 1 (PRIOR ART)
FIG. 1 shows a prior art CT device including an x-ray tube assembly and cooling system.

As described in the BACKGROUND with reference to FIG. 1, the coolant fluid circulated throughout the closed circulation system serves at least two purposes: (1) providing electrical insulation between the anode connection and ground (and/or the cathode connection) and (2) removing heat generated by the x-ray tube assembly. Inevitably, the oil breaks down; in other words, its dielectric properties, as well as its ability to carry away heat (i.e., viscosity), degrades. Thus, to reduce and/or delay x-ray tube failures thereby extending the service life of an x-ray tube, the present invention employs regular coolant fluid changes.

A fluid change, based on predetermined criteria, rejuvenates the cooling system by replacing old fluid with new fluid not only to better carry away the heat but also to provide the proper insulation (i.e., dielectric barrier) between the anode and ground (and/or cathode connections). Providing new fluid with fresh dielectric properties prevents, at least temporarily, the increased arcing which may otherwise occur if the old oil remained in the system and which would eventually result in x-ray tube failure.

X-ray tubes typically include a manufacturer's warranty for approximately 40,000 slices where a slice is a single picture taken by a computerized tomography (CT) scanner. Although x-ray tubes have been known to last as long as 75,000 slices, experiments using the present invention have shown that by performing regular fluid changes the life of an x-ray tube can be substantially extended. In one example, the service life was extended to approximately 300,000 slices; and, another, still functioning, is over 125,000 slices.

Figure 2A:
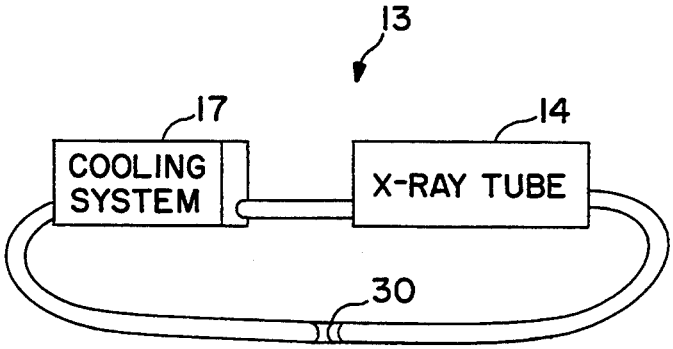
FIG. 2a (PRIOR ART)
FIGS. 2*a*, 2*b* and 2*c* illustrate, according to the present invention, an x-ray tube assembly and cooling system configuration for changing the cooling system fluid.

FIG. 2*a* shows a closed circulation system 13 including an x-ray tube assembly 14 and a cooling system 17.

Figure 2B:
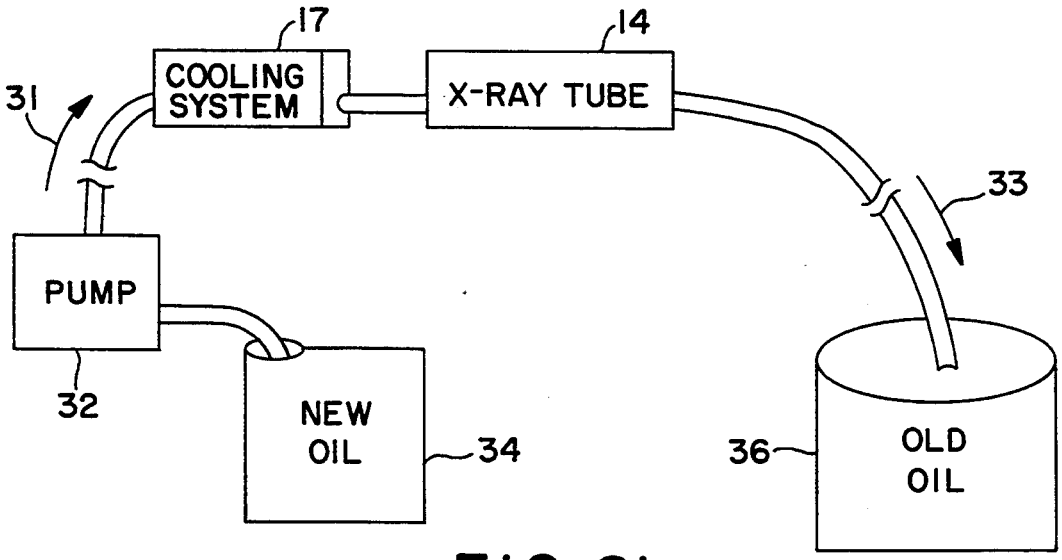

In FIG. 2*b*, an individual (e.g. technician or maintenance specialist) opens closed circulation system 13 to create an access to the fluid which circulates therein. This access may be via a quick-action coupling 30 or it may require breaking a seal. A pump 32 coupled to a source of new oil 34 is coupled to one end of the access point while the other end is situated to feed into a container 36 for holding old oil. When pump 32 is turned on it pumps new oil, as indicated by arrow 31, into the system thereby forcing the old oil out, as indicated by arrow 33, and into old oil container 36. When substantially new oil is detected flowing into old oil container 36, pump 32 is turned off and the access point is closed, thus, reconstructing closed circulation system 13 of FIG. 2*a*.

B. Detailed Description of the Invention

1. Fluid Change

Figure 3:
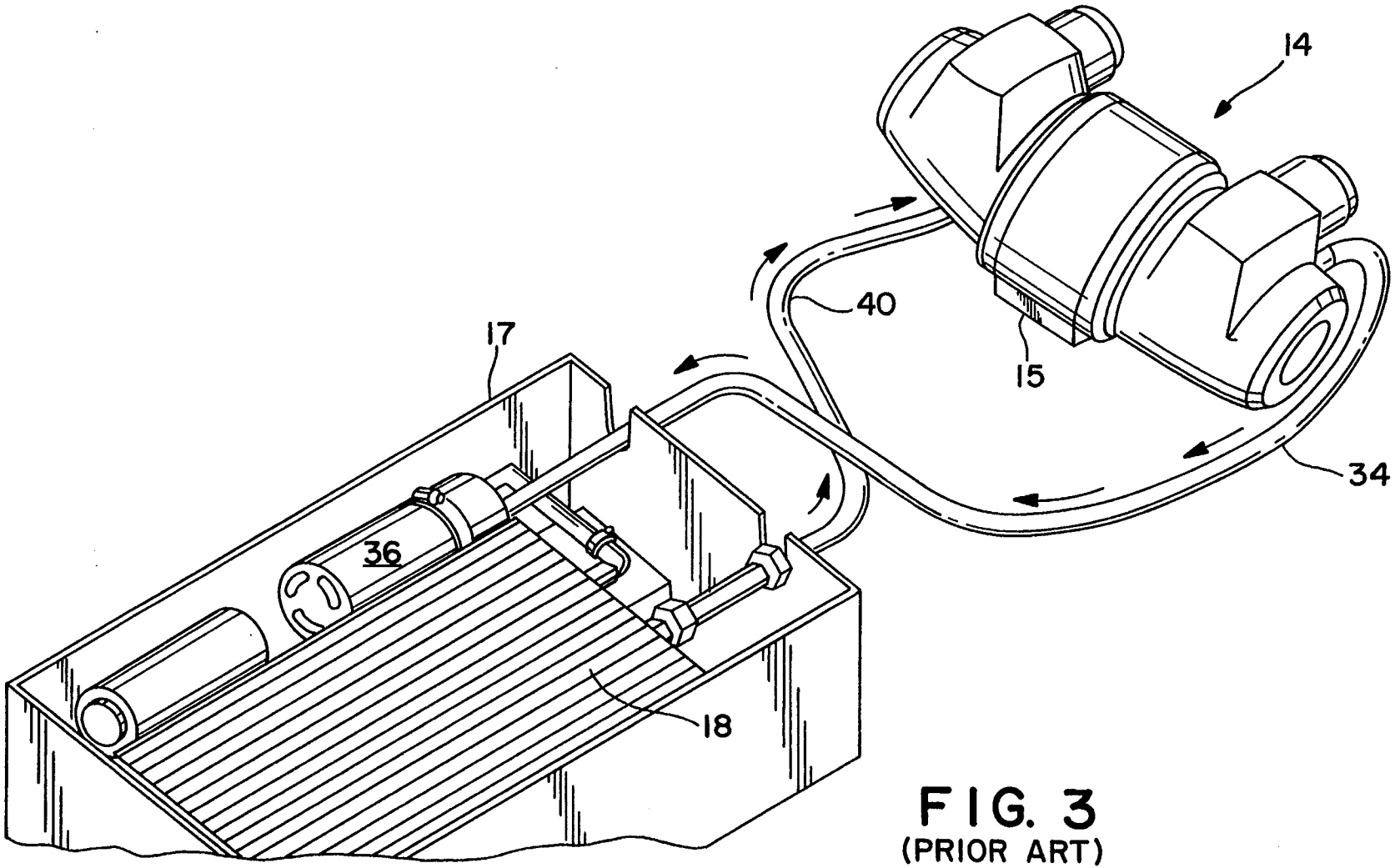
FIG. 3 (PRIOR ART)
FIG. 3 shows additional details of the x-ray tube assembly and cooling system of FIG. 1.

FIG. 3 shows additional details of the prior art x-ray tube assembly 14 and cooling system 17 of FIG. 1. As indicated by the arrows, pump 35 receives hot fluid from line 34 and moves the hot fluid through heat exchanger 18. The cooled fluid is returned to x-ray tube assembly 14 via line 40. Typically, the fluid is oil. In the exemplary embodiment of the present invention, the oil used is a light transformer oil which is initially clear in color but which, after continued use, becomes opaque (e.g., dark brown). It should be understood by those skilled in the art that other fluids suitable for use in an x-ray tube cooling system would also suffice.

The color of the oil, when accessible, is one way to determine when an oil change is necessary. As the oil breaks down and becomes "dirty", the color of the oil becomes darker. If the color of the oil is accessible, then periodic visual inspections can determine when an oil change is needed.

If the color of the oil is not accessible via, for example, an in-line window such as a transparent air-trap, alternate techniques for determining when to change the oil can be employed. Some contemplated alternate techniques include: (1) installing a monitor system for on-line testing of the thermal and/or dielectric properties of the oil, (2) installing an optical sensor in the circulation path which signals when the oil has reached a predetermined color, and/or (3) changing the oil, albeit less precise, based on other predetermined criteria such as the number of arcs, slices, calender days, patients, etc.

Once it has been determined that the oil needs to be changed, access to the oil needs to be gained. The accessibility of the oil depends on the particular system. In the exemplary embodiment of the present invention, at least one quick-action coupling 30 is used in the system which provides quick and convenient access to the oil. Quick-action coupling 30 operates such that when the coupling is decoupled, both ends automatically close, thus, preventing any oil from spilling out of the system.

However, other systems such as the CT-MAX tube by Eldco, Inc., Ontario, Calif., in which the x-ray tube assembly and cooling system are integrated as a single unit make it more difficult to access the oil. In systems such as this, usually a seal will have to be broken in order to gain access to the oil. Once the oil is changed, however, the seal needs to be repaired. It is contemplated that a quick-action coupling would be permanently installed, with any necessary extension tubing, in order to render subsequent oil changes easier and more convenient.

It should be understood by those skilled in the art that the present invention can be employed by CT scanners which have both the x-ray tube assembly and cooling system mounted on the gantry (e.g., U.S. Pat. Nos. 5,086,449 and 4,115,697 which are herein incorporated by reference) or which have the x-ray tube assembly mounted on the gantry and the cooling system located at a stationary location (e.g., U.S. Pat. No. 5,012,505 which is herein incorporated by reference).

Once access has been gained, the oil needs to be changed. Referring back to FIGS. 2*a* and 2*b*, the quick-action coupling 30 is decoupled.

Next, the old oil is replaced by new oil. A pump 32 coupled to a source of new oil 34 is coupled to one end of the access point while the other end is situated to feed into a container 36 for holding old oil. When pump 32 is turned on it pumps new oil into the system thereby forcing the old oil out and into the old oil container 36.

It should be noted that when an x-ray tube is generating radiation and, consequently, heat, both the temperature and the pressure of the system increase. Thus, most x-ray tube assemblies include a means for accomodating pressure changes in the closed circulation system. For example, some x-ray tube assemblies include a bellows (see FIG. 5) in the closed circulation system which can expand or compress based on the pressure within the system.

However, this device for accomodating pressure changes has practical limits; therefore, it is necessary to take great care when pumping the new oil into the system so as to not damage this pressure sensitive device (e.g., bellows) and, consequently, the x-ray tube assembly. In the exemplary embodiment of the present invention, the activity of the bellows is monitored by removing a panel on the housing of the x-ray tube assembly, whereby visual inspection is used to monitor the bellows in order that an adequate pumping pressure can be determined and maintained.

Figure 2C:
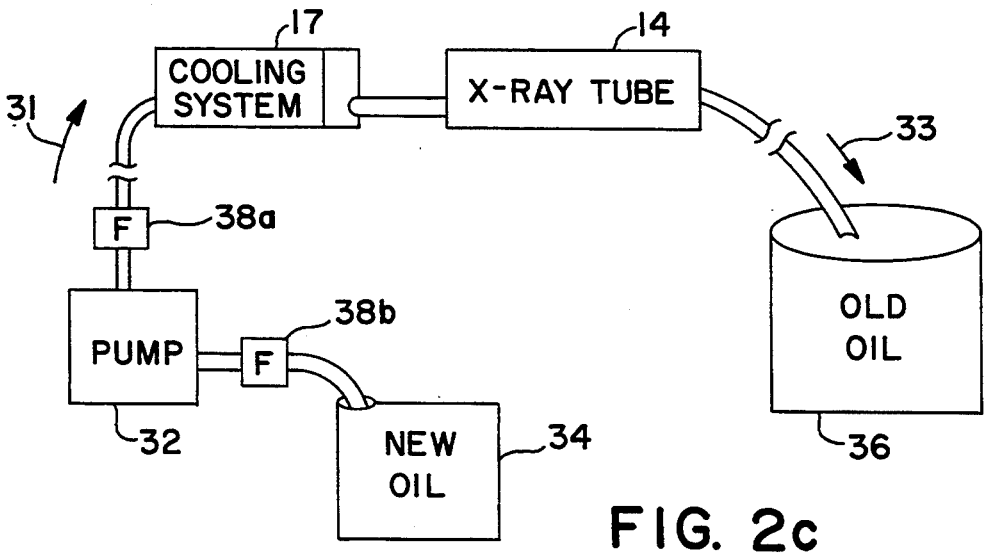

Referring back to FIGS. 2*a–c*, the new oil may be filtered before being pumped into the cooling system as shown in FIG. 2*c*. An oil filter 38 can be placed either before (38*b*) or after (38*a*) pump 32 as a precautionary measure to prevent contaminated oil from being pumped into the system.

In the exemplary embodiment of the present invention, a separate pump 32 is used to pump new oil into the system. However, it is contemplated that the pump 35 which is part of the cooling system 17 could be used to perform the same function. The new oil forces the old oil out of system 13 and into old oil container 36.

To determine when to stop pumping new oil into system 13, in the exemplary embodiment, a visual inspection of the oil being flushed from system 13 is made by the individual changing the oil. When the oil flowing into old oil container 36 is substantially clear (or the color of new fluid), then pumping is terminated. Again, this could be accomplished with an in-line window.

As with determining when to change the oil, some additional techniques for determining when to stop pumping have been contemplated and include: (1) installing a monitor system for on-line testing of the thermal and dielectric properties of the oil, (2) installing an optical sensor in the exit path which signals when the oil has reached a predetermined color, and/or (3) stopping the flow of new oil based on a predetermined amount of new oil pumped into the system.

Once the flow is stopped, the access point is closed (i.e., quick-action coupling 30 is recoupled) and the cooling system along with the x-ray tube, once again, are a closed system.

It should be noted, however, that during the process of replacing the old oil, air and/or gases may enter the circulation system and become trapped, particularly in the x-ray tube assembly. The air and gases must removed. In the exemplary embodiment of the present invention, an air trap exists in the path of the circulation system to remove the air as it circulates with the oil. It should be noted that the existence of the air trap could be permanent or it could be temporarily installed for oil change purposes.

Figure 4:
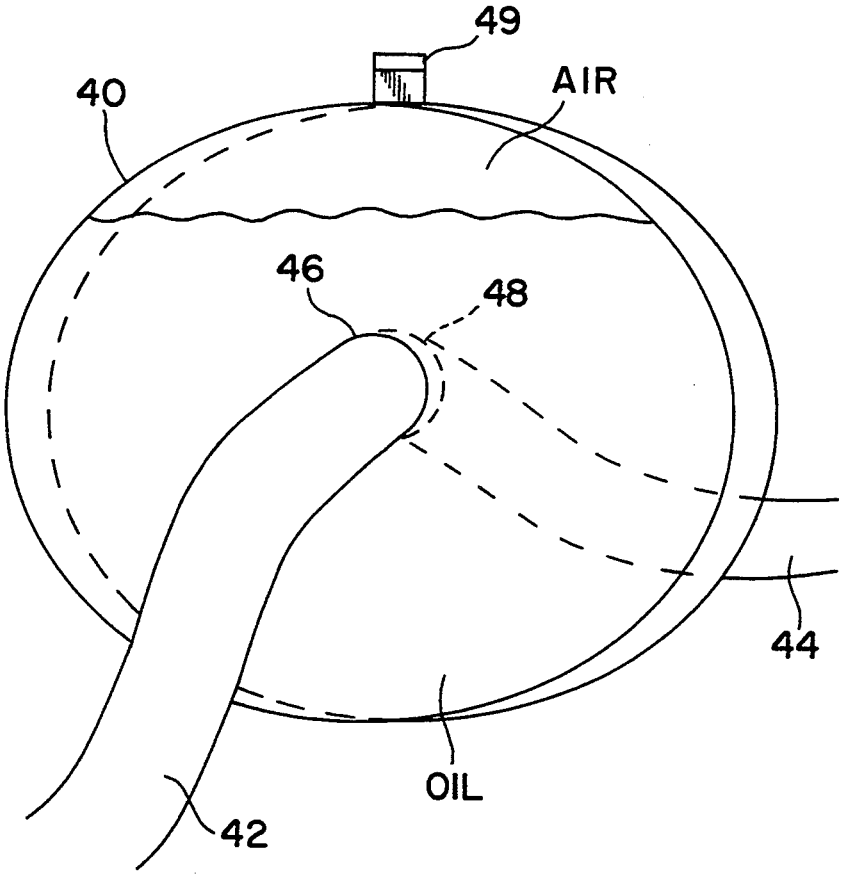
FIG. 4 shows an air trap suitable for use with the invention of FIG. 2*b;*

FIG. 4 shows an air trap 40 suitable for use with the present invention. Air trap 40 is circular so when the gantry (see FIG. 1) rotates the collected air accumulates at the top. Air trap 40 has two openings 46 and 48 opposing one another and approximately located at its center. The openings are coupled to separate tubes 42 and 44 such that circulating oil passes through air trap 40 when travelling from tube 42 to 44. While the circulating oil is in air trap 40, air contained in the oil rises through the oil to the top of air trap 40, hence, removing it from the system. The trapped air can then be released by bleeder 49. An example of such a device is the gas collector made by Siemens in Iselin, N.J. A different apparatus for removing bubbles can be found in U.S. Pat. No. 5,086,449.

After the oil change, the air trap is used by running the cooling system pump 36 in order to circulate the new oil and attempt to trap any air/gas in the system. Typically, the system pump 36 is allowed to run for approximately one hour to ensure that substantially all of the air and/or gas has been removed. However, in the exemplary embodiment of the present invention, the system pump only runs for approximately 15 minutes while the gantry 12 (which houses the x-ray tube 14 and cooling system 17) is tilted and/or rotated in an attempt to dislodge or "free-up" any bubbles trapped in the system so they can circulate and be trapped. The gantry can typically be tilted by ±20°–25° and rotated by 360°.

2. Fluoroscopy

In addition to the breakdown of the coolant fluid, another problem with an x-ray tube is the vaporization of the anode and filament (both are typically constructed of tungsten) within the glass envelope.

Figure 5:
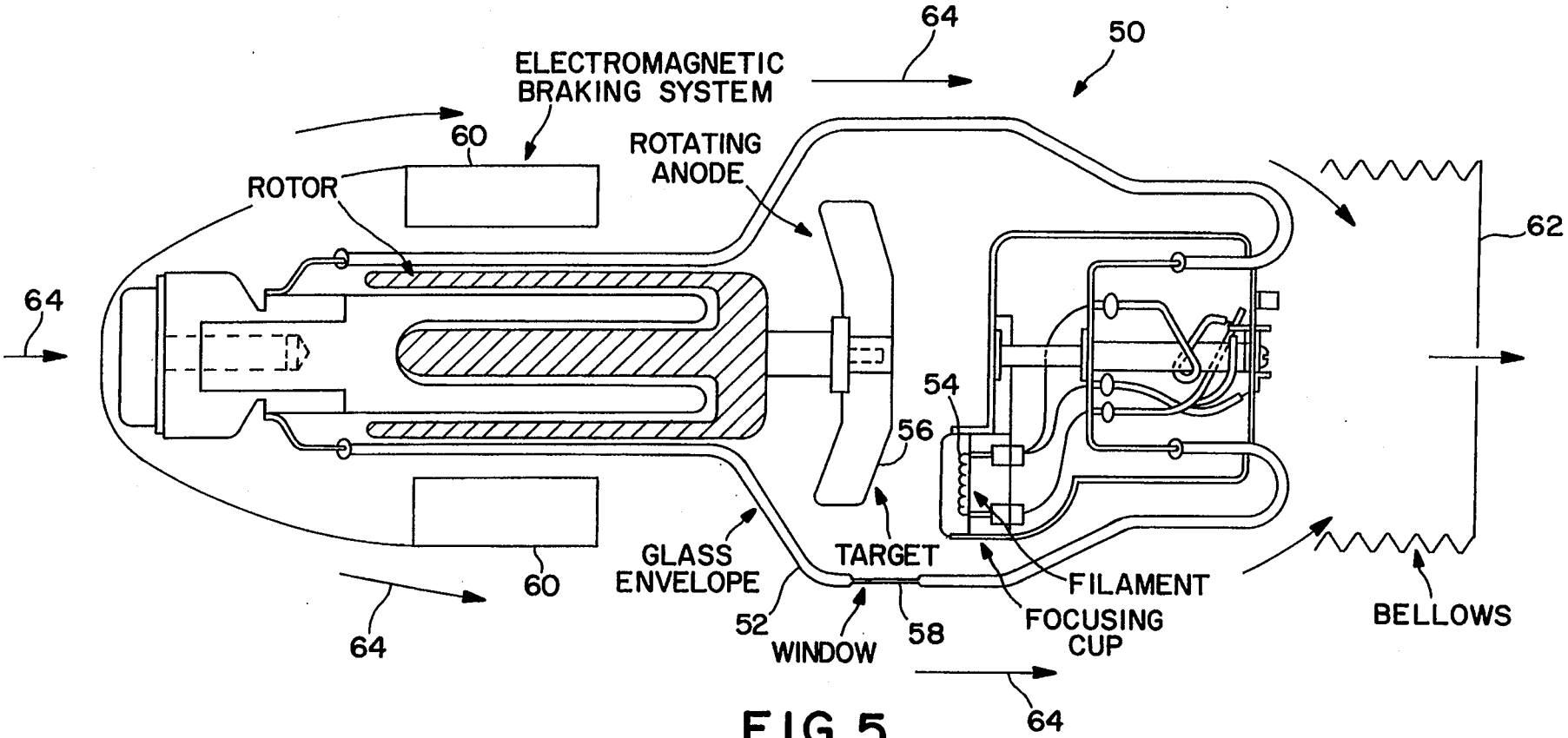
FIG. 5 (PRIOR ART)
FIG. 5 shows additional details of the x-ray tube assembly of FIGS. 1, 2*a*, 2*b*, 2*c* and 3.

FIG. 5 shows additional details of the x-ray tube assembly. X-ray tube 50 is housed in a glass envelope 52. Within glass envelope 52 is a filament 54 for generating a stream of electrons which bombard an angled, rotating anode 56. The resultant collision creates a planar beam of radiation which is deflected through a window portion 58 of glass envelope 52 and aimed at a patient. Also included in x-ray tube assembly 14 is a braking mechanism 60 for settling a rotating anode and a bellows 62 for accomodating pressure changes in the closed circulation system. Arrows 64 indicate the direction of oil flow through x-ray tube assembly 14.

Because of the high temperature of filament 54 during operation, tungsten atoms are slowly vaporized and plate the inside of glass envelope 52, even with normal use. This tungsten, along with that vaporized from anode 56, disturbs the electrical balance of the x-ray tube, causing abrupt, intermittent changes in tube current, which often leads to arcing and tube failure.

To minimize, if not eliminate, the likelihood of this problem thereby further extending the service life of the x-ray tube, regular on-line fluoroscopies are performed. A on-line fluoroscopy substantially reduces the condition (i.e., also known as a "gassy" condition) caused by the vaporized tungsten.

Figure 6:
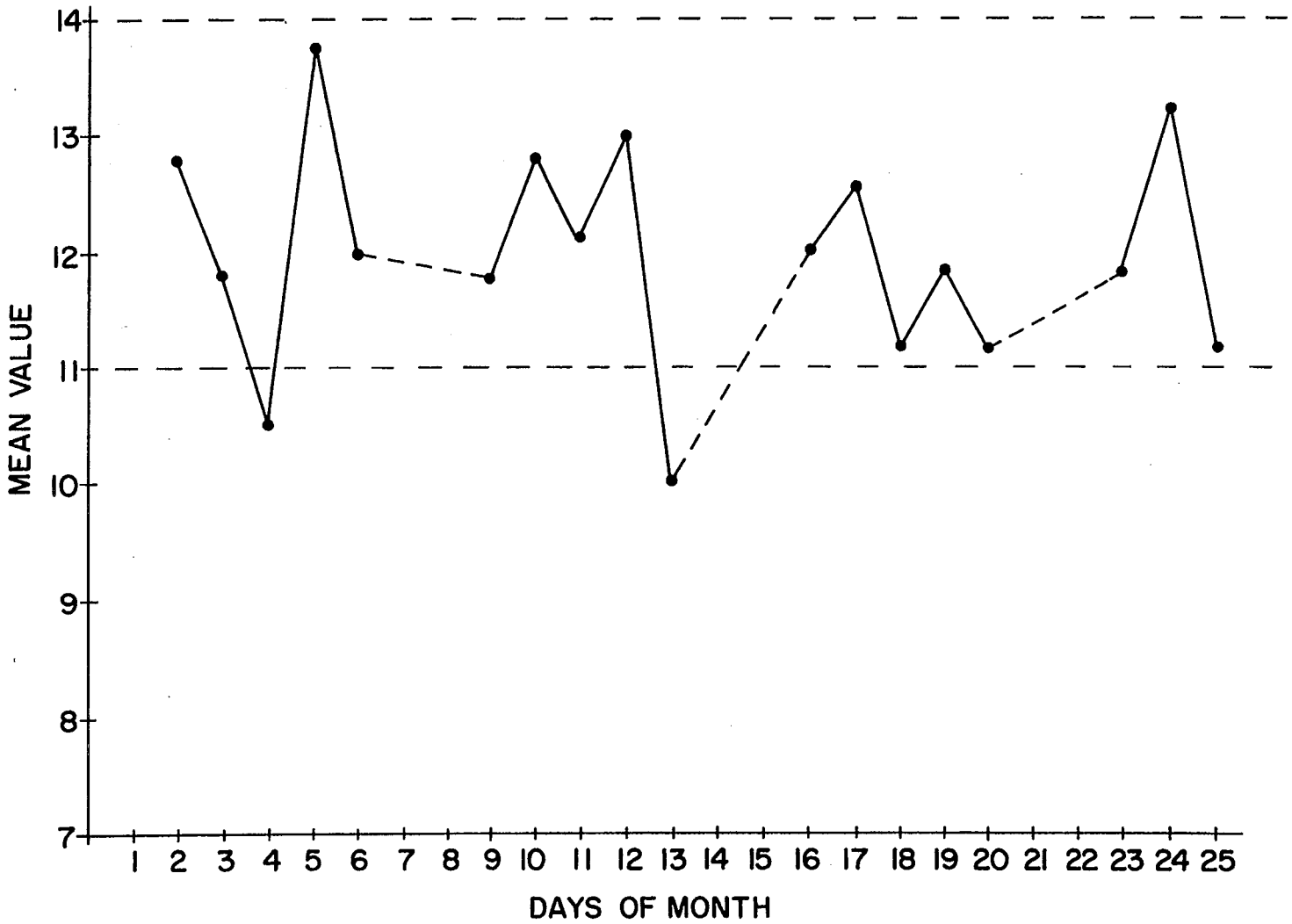
FIG. 6 shows a chart of daily calibration results for detecting a gassy conditon.

To determine when a fluoroscopy is needed, a technician or other equally skilled individual should periodically analyze the results of the daily CT scanner calibration. As the intensity of the radiation during a calibration (i.e., phantom test) continues to diminish over time, a threshold can be set to indicate the need for an on-line fluoroscopy. FIG. 6 is an example of a chart tracking daily test results for a CT scanner. In FIG. 6, the Y-axis represents a mean value indicative of the beam intensity, while the X-axis tracks the days of a month. A value of 7 is typically achieved with a new x-ray tube and the range from approximately 11 to 14 indicates a gassy condition.

It should be noted that, in the exemplary embodiment of the present invention, the on-line fluoroscopy is performed along with the above-described fluid change in order to make efficient use of a CT scanner's down time.

The on-line fluoroscopy requires that the CT scanner system generator be set to deliver 125 kilovolts at 3–5 milliamps (versus 125 kv and 400 ma for several seconds for typical beam generation). This setting is maintained for approximately ½ hour at which time the CT scanner is recalibrated in order to gauge the improvement gained by the on-line fluoroscopy.

It should be noted that for some systems such as Siemens CT with micromatic generator, the on-line fluoroscopy requires the individual performing the fluoroscopy to remain with the system controls for the full ½ hour; whereas, other systems such as Siemens CT with Pandoras generator only require the individual to set the generator and return in approximately ½ hour.

3. Braking Mechanism

In addition to the generation of radiation being a source of heat, heat is also generated by a braking mechanism 60 used to settle rotating anode 56. Eventually, braking mechanism 60 as well as failing bearings (not shown) are also a source of discomforting noise.

Experiments show that the braking of the rotating anode 56 may produce adverse affects, especially to the bearings of rotating anode 56.

Thus, in an alternate embodiment of the present invention, in addition to the above-described techniques for extending the service life of an x-ray tube, the braking mechanism 60 for the rotating anode is often disabled (i.e., the wires are disconnected). This means that after radiation has been generated, rotating anode 56 is allowed to continue rotating until it settles on its own without the assistance of braking mechanism 60.

Although the invention is illustrated and described herein embodied as a method and system of performing regular fluid changes for CT x-ray tubes, the invention is nevertheless not intended to be limited to the details as shown. Rather, various modifications may be made in the details within the scope and range of equivalents of the claims and without departing from the spirit of the invention.

What is claimed:

1. In a radiographic apparatus having an x-ray tube coupled to a cooling system and the cooling system circulates an existing fluid through a closed circulation system which includes the x-ray tube to remove heat and provide electrical insulation, a method for extending the service life of the x-ray tube in the radiographic apparatus comprising the steps of:

a) determining, based on predetermined criteria, that the existing fluid be replaced;

b) opening the closed circulation system, without removing the x-ray tube, to gain access to the existing fluid;

c) replacing substantially all of the existing fluid with new fluid by way of the opening in step b);

d) closing the circulation system; and e) protecting the x-ray tube from damage during or after replacement of the existing fluid but prior to operating the x-ray tube again, thereby replacing the existing fluid in the closed circulation system without damaging or removing the x-ray tube.

2. The method according to claim 1 wherein the predetermined criteria includes a visual inspection of a color of the existing fluid.

3. The method according to claim 1 further comprising the steps of:

e) determining, based on further predetermined criteria, that an on-line fluoroscopy be performed; and f) performing said on-line fluoroscopy.

4. The method according to claim 1, wherein said x-ray tube includes a braking mechanism to settle a rotating anode, further comprising the step of:

e) disabling said braking mechanism.

5. The method according to claim 1, wherein said x-ray tube includes a pressure sensitive means for accommodating pressure changes within said closed circulation system, and wherein protecting the x-ray tube during replacement of the existing fluid comprises the step of:

e) monitoring said pressure sensitive means to determine and maintain the flow of new fluid in step c) such that the x-ray tube is not damaged.

6. In a radiographic apparatus having an x-ray tube coupled to a cooling system and the cooling system circulates an existing fluid in a closed circulation system including the x-ray tube to remove heat and provide electrical insulation, a method for extending the service life of the x-ray tube in the radiographic apparatus comprising the steps of:

a) determining, based on first predetermined criteria, that the existing fluid be replaced;

b) opening the closed circulation system, without removing the x-ray tube, to provide first and second openings;

c) coupling one of said first and second openings to a source of new fluid under pressure, wherein the new fluid flows into and flushes out substantially all of the existing fluid from the opened circulation system;

d) containing the existing fluid flowing from the other of said first and second openings;

e) determining, based on second predetermined criteria, that the new fluid has sufficiently flushed the circulation system;

f) closing the first and second openings of the closed circulation system; and g) removing substantially any gas introduced during steps b) through f) from the closed circulation system and prior to operating the x-ray tube again, thereby replacing the existing fluid in the closed circulation system without damaging or removing the x-ray tube.

7. The method according to claim 6 wherein the gas is removed using a transparent air trap and the predetermined criteria includes a visual inspection of a color of the existing fluid by way of the transparent air trap.

8. The method according to claim 6 further comprising the steps of:

g) determining, based on third predetermined criteria, that an on-line fluoroscopy be performed;

h) performing said on-line fluoroscopy.

9. The method according to claim 6, wherein said x-ray tube includes a braking mechanism to settle a rotating anode, further comprising the step of:

g) disabling said braking mechanism.

10. The method according to claim 6, wherein said x-ray tube includes a pressure sensitive means for accommodating pressure changes within said closed circulation system, and wherein protecting the x-ray tube during replacement of the existing fluid comprises the step of:

g) monitoring said pressure sensitive means to determine and maintain the flow of new fluid in step c) such that the x-ray tube is not damaged.

11. In a radiographic apparatus having an x-ray tube coupled to a cooling system, wherein the cooling system circulates an existing fluid through a closed circulation system which includes a first pump means and the x-ray tube to remove heat and provide electrical insulation, a system for changing the existing fluid in order to extend the service life of the x-ray tube comprising:

a) a source of new oil;

b) a second pump means, different from the first pump means and coupled between said source of new oil and said closed circulation system, for pumping said new oil into said closed circulation system to force out said existing oil; and c) container means, coupled to said closed circulation system, for receiving said existing oil forced out of said closed circulation system by said new

12. The system according to claim 11, further comprising a filter means, coupled between said pump means and said closed circulation system, for filtering new oil before said new oil enters said closed circulation system.

13. The system according to claim 11, further comprising an air trap means, coupled within said closed circulation system, for trapping air and/or gases within said closed circulation system.

14. In a radiographic apparatus having an x-ray tube coupled to a cooling system and the cooling system circulates an existing fluid through a closed circulation system which includes the x-ray tube to remove heat and provide electrical insulation, the cooling system being housed in a gantry, a method for extending the service life of the x-ray tube in the radiographic apparatus comprising the steps of:

a) determining, based on predetermined criteria, that the existing fluid be replaced;

b) opening the closed circulation system, without removing the x-ray tube, to gain access to the existing fluid;

c) replacing substantially all of the existing fluid with new fluid by way of the opening in step b);

d) closing the circulation system; and e) removing, from the closed circulation system, substantially any air introduced during steps b) through d) and prior to operating the x-ray tube again, the step of removing any gas further including the step of tilting and rotating the gantry while operating the cooling system to dislodge air bubbles trapped in the x-ray tube and system so the air bubbles can circulate, get trapped and be removed, thereby replacing the existing fluid in the closed circulation system without damaging or removing the x-ray tube.

* * * * *